US010088269B2

(12) United States Patent
Sheets, Jr. et al.

(10) Patent No.: US 10,088,269 B2
(45) Date of Patent: Oct. 2, 2018

(54) FIREARM WITH INTEGRATED POWER SOURCE

(71) Applicant: Sig Sauer, Inc., Newington, NH (US)

(72) Inventors: Robert E. Sheets, Jr., Portland, OR (US); Donald Cramer, Beaverton, OR (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 15/403,534

(22) Filed: Jan. 11, 2017

(65) Prior Publication Data

US 2017/0205191 A1 Jul. 20, 2017

Related U.S. Application Data

(60) Provisional application No. 62/279,211, filed on Jan. 15, 2016.

(51) Int. Cl.

| | |
|---|---|
| ***F41C 23/22*** | (2006.01) |
| ***F41C 23/10*** | (2006.01) |
| ***F41C 27/00*** | (2006.01) |
| ***F41A 35/00*** | (2006.01) |
| ***F41G 1/34*** | (2006.01) |
| *F41A 19/69* | (2006.01) |

(52) U.S. Cl.

CPC ..... *F41C 27/00* (2013.01); *F41A 35/00* (2013.01); *F41C 23/10* (2013.01); *F41G 1/34* (2013.01); *F41A 19/69* (2013.01)

(58) Field of Classification Search

CPC ..... F41C 23/10; F41C 23/22; F41C 27/00; F41G 1/32; F41G 1/34; F41G 1/345; F41G 1/35; F41G 1/36; F41A 19/69; F41A 35/00

USPC ..... 42/71.02, 114, 115, 132, 146

See application file for complete search history.

(56) References Cited

U.S. PATENT DOCUMENTS

| | | | | | |
|---|---|---|---|---|---|
| 689,547 | A * | 12/1901 | James | F41G 1/34 | 362/113 |
| 849,198 | A * | 4/1907 | Boust | F41G 1/35 | 353/43 |
| 1,120,769 | A * | 12/1914 | Villarejo | F41G 1/35 | 362/114 |
| 1,149,705 | A * | 8/1915 | Ward | F41G 1/34 | 362/114 |
| 1,150,796 | A * | 8/1915 | Ward | F41G 1/35 | 362/114 |
| 1,615,409 | A * | 1/1927 | Selden | F41C 23/10 | 362/114 |
| 2,056,975 | A * | 10/1936 | Michal, Jr. | F41A 19/44 | 42/106 |
| 4,934,086 | A * | 6/1990 | Houde-Walter | F41A 3/86 | 362/110 |

(Continued)

*Primary Examiner* — Bret Hayes

(74) *Attorney, Agent, or Firm* — Finch & Maloney PLLC

(57) ABSTRACT

A firearm is described that includes an integrated power source, socket, and conductor connecting the power source to the socket. By integrating these elements into a firearm, a powered accessory can be attached to the firearm without the need for a mounting rail attached to a firearm. Furthermore, powered accessories need not have their own integrated power sources, but rather can connect to the power source within the firearm. This reduces the weight and physical dimensions of both firearms and accessories.

15 Claims, 4 Drawing Sheets

(56) References Cited

U.S. PATENT DOCUMENTS

| | | | | |
|---|---|---|---|---|
| 5,179,235 | A * | 1/1993 | Toole | F41G 1/35 362/110 |
| 5,237,773 | A * | 8/1993 | Claridge | F41G 1/35 362/113 |
| 5,481,819 | A * | 1/1996 | Teetzel | F41A 9/62 42/117 |
| 5,706,600 | A * | 1/1998 | Toole | F41G 1/35 362/114 |
| 2009/0071053 | A1 | 3/2009 | Thomele et al. | |

* cited by examiner

FIREARM WITH INTEGRATED POWER SOURCE

RELATED APPLICATIONS

This application claims priority under 35 USC § 119(e) to U.S. Provisional Patent Application No. 62/279,211, entitled "Firearm with Integrated Power Source," filed on Jan. 15, 2016, which is incorporated by reference herein in its entirety.

TECHNICAL FIELD

The present disclosure relates generally to firearms and firearm accessories. Specifically, the present disclosure related to a firearm with an integrated power source used to power an accessory attached to the firearm.

BACKGROUND

Firearm accessories, such as optical scopes, lights, night vision devices, and bipods, are typically attached to a firearm using a standardized mounting feature. One type of standardized mounting feature often integrated with a firearm, and to which an accessory may be attached, is commonly referred to as a "rail." An accessory requiring power for operation (such as a light, a laser sight, a night vision device, etc.) typically includes a power source that is integrated with the accessory itself. The powered accessory, and its power source, are attached to the rail of the firearm prior to use.

SUMMARY

In one example of the present disclosure, a firearm includes a grip, a barrel assembly frame connected to the grip, a trigger guard connected to the grip and the barrel assembly frame, and an elongate conductor frame disposed within the firearm having a first frame end and a second frame end, the first frame end disposed within the grip and the second frame end disposed at an end of the barrel assembly frame opposite the grip. In one embodiment, the firearm further includes a conductor in contact with the elongate conductor frame, the conductor including a first conductor end disposed proximate to the first frame end of the elongate conductor frame, the first conductor end including at least one electrical contact point and a second conductor end disposed proximate the second frame end of the elongate conductor frame. In one embodiment, the second conductor end is connected to a socket disposed on an underside of the barrel assembly frame. In one embodiment, the socket is a multi-pin socket. In one embodiment, a portion of the conductor is disposed within the trigger guard. In one embodiment, the conductor is a flex circuit. In one embodiment of this example, the elongate conductor frame includes a plurality of clips configured to urge a conductor against a surface of the elongate conductor frame. In one embodiment, the elongate conductor frame defines a plurality of fixture channels, each fixture channel of the plurality configured to receive a fixture pin inserted through a firearm injection mold that defines a plurality of fixture holes. In one embodiment, the firearm further includes a power source compartment defined by the grip, the power source compartment configured to receive a portable power source. In one embodiment, the firearm further includes a powered accessory connected to barrel assembly frame.

In one example of the present disclosure, a method of manufacturing a firearm frame having an integrated power circuit includes providing a firearm frame mold, a conductor, an elongate conductor frame, assembling the conductor with the elongate conductor frame to form a conductor assembly, inserting the conductor assembly into the firearm frame mold, and injecting a material into the firearm frame mold. In one embodiment, the providing further includes providing the firearm frame mold with a plurality of fixture holes defined by the firearm frame mold, providing the elongate conductor frame with a plurality of fixture channels defined by the elongate conductor frame, and providing a plurality of fixture pins. In one embodiment, the method further includes connecting the conductor assembly to the firearm frame mold by aligning at least some of the fixture holes of the firearm frame mold with corresponding fixture channels of the elongate conductor frame and inserting a fixture pin of the plurality of fixture pins through each fixture hole aligned with a corresponding fixture channel. In one embodiment, assembling the conductor with the elongate conductor frame includes mounting the conductor on a surface of the elongate conductor frame. In one embodiment, the mounting comprises urging the conductor to the surface of the elongate conductor frame using at least one clip.

The figures depict various embodiments of the present disclosure for purposes of illustration only. Numerous variations, configurations, and other embodiments will be apparent from the following detailed discussion.

DETAILED DESCRIPTION

Overview

While accessories attached to firearms improve the function and versatility of the firearms, the inclusion of a mounting rail on the firearm to which accessories are attached increases the weight of the firearm and the physical dimensions of portions of the firearm, even before an accessory itself is attached. Increasing one or both of the weight and the physical dimensions of a firearm can be undesirable by making the firearm more difficult to use (e.g., heavier to lift or move, harder to withdraw from a holster). Furthermore, accessories that use power for operation (e.g., laser sights, lights, night vision equipment), generically referred to as "powered accessories" herein for convenience, include a power source (e.g., a battery) that further increases the weight and the physical dimensions of the accessory and the firearm to which it is attached.

To improve the convenience and utility of firearms with an attached powered accessory, embodiments of the present disclosure include at least an integrated: (1) power source; (2) socket; and (3) conductor connecting the power source to the socket. By integrating these elements into a firearm, the need for a mounting rail on a firearm and an independent power source for an accessory are obviated. One benefit of a firearm having an integrated power source, socket, and conductor is a reduction of the weight and physical dimensions of a firearm compared to conventionally mounted and conventionally powered accessories discussed above.

Fabrication of some embodiments of the present disclosure is accomplished by mounting, connecting, or assembling a conductor on an elongate conductor frame that defines a plurality of fixture channels. These two elements together are termed a conductor assembly. The conductor assembly is placed within a firearm frame mold that defines a plurality of fixture holes, at least some of which correspond to fixture channels of the conductor assembly. One or more fixture pins are inserted through one or more fixture holes defined in the firearm mold and into a corresponding, aligned fixture channel in the elongate conductor frame, thus fixing a position of a portion of the elongate conductor frame with respect to the firearm mold. Thus, the elongate conductor frame (and the attached conductor) will not move during molding of the firearm.

Firearm Including an Integrated Conductor and Elongate Conductor Frame

Figure 1:
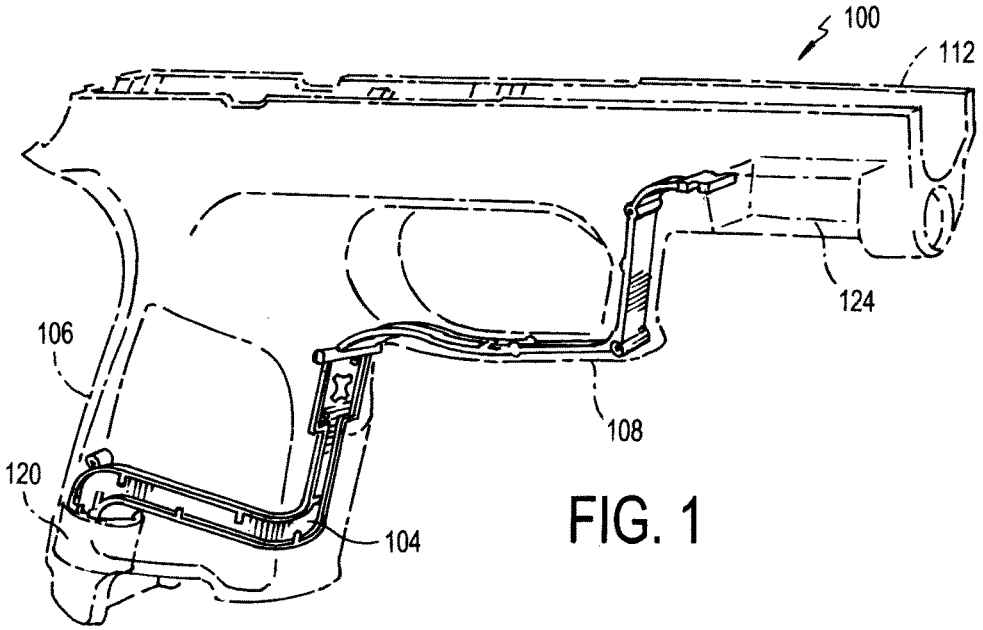
FIG. 1 is a perspective phantom view of a firearm frame, within which a conductor on an elongate conductor frame is disposed, in an embodiment of the present disclosure.

FIG. 1 illustrates an example embodiment of a firearm frame 100 that includes an integrated conductor assembly 104 (the elements of which are described below in more detail in the context of FIGS. 2A and 2B), a power source compartment 120, and a socket 124, among other elements described below. As is shown in FIG. 1 and explained in more detail below, the integration of the conductor assembly 104 enables provision of power from a power source connected to an accessory (not shown) through the conductor assembly 104. As indicated above, the benefits of such a configuration include reduced weight and smaller physical dimensions of a firearm equipped with a powered accessory. Other benefits include a more versatile firearm system because of the ease and convenience with which firearm accessories are changed on the firearm.

The firearm frame 100 includes a grip 106, a trigger guard 108, and a barrel assembly frame 112. In some embodiments, these elements are molded as an integral unit out of one or more of polymers, polymer blends, filled polymers and polymer blends, and non-polymer structural materials (e.g., carbon fibers, glass fibers, hollow beads, metallic elements) that are used with a polymer, polymer blend, or filled polymer to form a composite material. The grip 106 is configured to define a power source compartment 120 that is configured to receive a portable power source, such as a battery or fuel cell. The power source compartment 120 is described in more detail in the context of FIG. 4A. The grip 106 is also configured to receive a magazine containing ammunition (not shown).

The trigger guard 108 is disposed around a portion of the firearm that includes, upon final assembly of the firearm, a trigger (not shown) that, when actuated, causes a projectile (e.g., a metal bullet, a rubber bullet, an explosive projectile, or other projectile) to be fired from the firearm. The trigger guard 108 acts as a physical barrier to unintentional actuation of the trigger. As is shown in FIG. 1, a middle portion of the conductor assembly 104 is disposed within the trigger guard 108 in this embodiment of the present disclosure, although the route of the conductor assembly 104 is not intended to limit the possible locations of the conductor assembly 104 within the firearm frame 100.

In the example embodiment shown in FIG. 1, the barrel assembly frame 112 defines a channel in which a barrel, a trigger, a firing mechanism, and (in the case of an automatic firearm) a round-casing ejection mechanism are received, all of which are omitted from FIG. 1 for clarity. In this example embodiment of a firearm frame 100, the elements of the barrel assembly that are ultimately placed within the barrel assembly frame 112 are fabricated separately, but this not required.

In the example embodiment of FIG. 1, a socket 124 is disposed in a socket chamber on an underside of the barrel assembly frame 112. The socket 124 is configured to receive a plug compatible with the socket 124 that is attached to an accessory so that power is transmitted from a power source in the power source compartment 120 through the socket 124 to the accessory. Socket 124 may also house, or partially house, a powered accessory such as a laser. As will be explained below in more detail in the context of FIG. 5, the example of the socket 124 of FIG. 1 is a multi-pin socket although any type of socket 124 may be used to provide an interface for electrical and/or mechanical communication with an accessory equipped with a compatible connector. Regardless of the type of socket 124 actually used, the socket is configured to receive power through the conductor assembly 104. It will be understood that the location of the socket 124 is not required to be in the location shown in FIG. 1, but rather can be varied according to the configuration of a firearm and the physical constraints imposed on the path followed by the conductor assembly 104 within a firearm.

While the configuration of the firearm frame 100 that is shown in FIG. 1 is that of a sidearm (i.e., a pistol), it will be understood that embodiments of the present disclosure are not limited to only sidearms. Rather, embodiments of the present disclosure are equally applicable to any of a variety of firearm configurations and types, such as rifles, shotguns, machine guns, and various other projectile devices for which powered accessories improve the versatility or function thereof. Furthermore, embodiments of the present disclosure are applicable to various firearms in which the locations of the various elements of FIG. 1 (e.g., a path followed by the conductor assembly 104, a location of a power source compartment 120, a location of a socket 124) are different from those shown.

Integrated Conductor and Elongate Conductor Frame

Figure 2A:
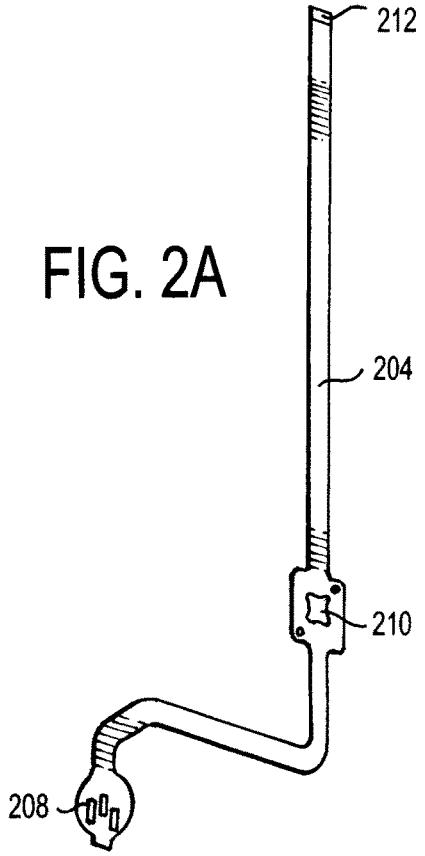
FIG. 2A is a perspective view of a conductor used to provide power from a power source integrated within a firearm to a firearm accessory, in an embodiment of the present disclosure.

FIG. 2A illustrates a conductor 204 of the conductor assembly 104 that is used to transmit power from a power source integrated within a power source compartment 120 of a firearm (including, but not limited to, the firearm 100 shown in FIG. 1) to an accessory attached to the firearm. The conductor 204 includes a power source contact 208, a switch 210, and a connector 212.

The example of the conductor 204 shown in FIG. 2A is a flexible polymer circuit ("flex circuit" for brevity). Typically, a flex circuit is a composite structure that includes a flexible, non-conductive polymer film substrate (such as polyimide or polyester) on which are disposed one or more metallic "traces" (not shown). The substrate provides mechanical support for the metallic traces, which in some cases would otherwise be too fragile to use in a manufacturing processes and/or for reliable use in a final application. The metallic traces, which are typically thin films of a metallic conductor, are disposed on a surface of the non-conductive substrate or in some cases between layers of a multi-layer polymer substrate. The polymer substrate provides flexible yet durable support that facilitates manipulation of the flex circuit as a whole while the conductive traces provide the electrical conductivity of the flex circuit. Furthermore, to increase stability of specific locations or for convenience of fabrication, additional rigid supports may be added to the conductor 204. Examples of these optional rigid supports include fiberglass pads that include an adhesive for convenient connection to the conductor 204 itself and/or to a proximate structure.

While the use of a flex circuit for the conductor 204 is convenient, other types of wiring may be used for the conductor 204 with equivalent results. Other examples of the conductor 204 include carbon fibers, graphite fibers, metallic wires wrapped in an insulator or bare metallic wires insulated by a later-deposited insulating material (such as the injected polymer used to form elements of the firearm itself). Regardless of the material used, or its specific configuration, the conductor 204 provides an electrical path within a firearm from an integrated power source to, ultimately, a powered accessory.

The power source contact 208 of the conductor 204 is, in the example shown, at a first end of the conductor 204 disposed within the grip 106 of the firearm frame 100. The power source contact 208 includes conductive contacts that are configured for either direct or indirect contact with a power source that is, in turn, received within the power source compartment 120. Examples of power source contact 208 include exposed metallic contacts that are in electrical contact with (or are a continuation of) the conductor 204.

The switch 210 is configured to either open or close (or open and close) the electrical circuit that includes the power source (not shown), the accessory (not shown) and the conductor 204. The switch 210 is configured to open and close this electrical circuit using pressure actuation, although other types of switches using other means of actuation may also be substituted for the switch 210 shown in FIG. 2A. While the switch 210 is shown in FIG. 2A as disposed at approximately a middle portion of the conductor 204, this is merely for convenience of explanation. The switch 210 may be positioned at any location with the circuit formed by the power source (not shown), the conductor 204, and the accessory (not shown) so that power may be selectively supplied to the accessory. That is, the location of the switch 210 on the conductor 204 may be closer to one end or an opposite end of the conductor depending on the configuration of the firearm (e.g. a rifle compared to a pistol).

The connector 212 is disposed at a second end of the conductor 204 opposite the first end and, in the example of the firearm frame 100, opposite the grip 106. The connector 212 in its broadest sense is an interface between the conductor 204 (or, for the example embodiment of FIG. 2A, the metallic traces of the flex circuit) and the socket 124 that is described in more detail in the context of FIG. 5. In this way, the connector 212 improves the manufacturability of a firearm by providing a structure for a repeatable and convenient electrical and/or mechanical connection between conductor 204 and the socket 124. For example, in some examples the connector 212 includes a housing that receives the conductor 204 (or the electrical current carrying portions thereof) at a first portion and that connects to the socket 124 at a second portion. One example of the connector 212 includes a rigid polymer (or other insulator) with conductive inputs that are configured to maintain electrical and mechanical connections with the conductor 204, conductive output contacts that are configured to maintain electrical and mechanical connections to a custom or standard interface on the socket 124.

The connection between the connector 212 and the conductor 204 is, in some examples, established prior to insertion of the conductor assembly 104 within the mold used to form some or the entire firearm frame 100. This can improve the manufacturability of a completed firearm that includes elements of the present disclosure because, in some examples, an electrical connection can be made more easily between the connector 212 and the socket 124 than compared to a direct connection between the connector 212 and the socket 124.

Figure 2B:
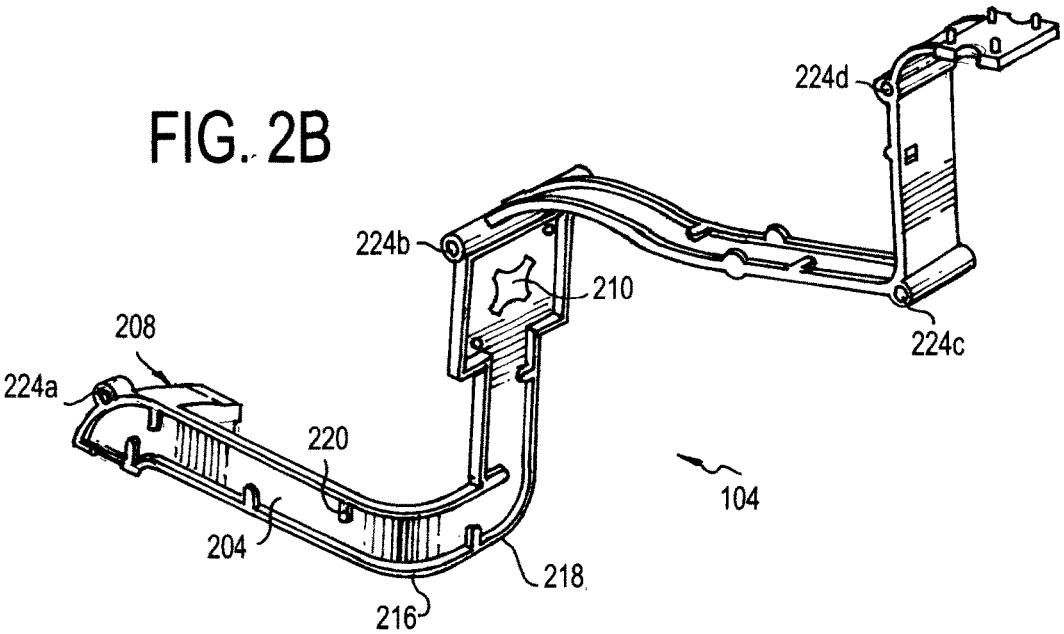
FIG. 2B is a perspective view of a conductor assembly disposed on an elongate conductor frame that can be integrated within a firearm frame and used to provide power from a power source integrated within a firearm to a powered accessory, in an embodiment of the present disclosure.

FIG. 2B illustrates an example of a conductor assembly 104 that includes both of the conductor 204 and an elongate conductor frame 216. As described above in the context of FIG. 2A, the conductor 204 in this examples includes power source contact 208, switch 210, connector 212 (not visible in this view), and, in this case, other elements of a flex circuit (e.g., a polymer substrate and metallic traces). The embodiment of the elongate conductor frame 216 shown in FIG. 2B includes a backing 218, a plurality of clips 220, and a plurality of fixture channels 224*a*-224*d* (collectively 224).

Because details of the conductor 204 are presented above in the context of FIG. 2A, no further discussion of the conductor 204 is necessary.

The backing 218 includes one or more segments of a rigid material (or materials), such as a non-conductive polymer (e.g., polyethylene, polypropylene, epoxy) or a polymer/non-polymer composite (e.g., fiberglass, a "filled" polymer, or other composite). The backing 218 is configured to follow some or all of a path from a power source compartment (such as power source compartment 120 in the firearm frame 100) to a location proximate to a socket (such as socket 124 in the firearm frame 100). In this way, the backing 218 provides mechanical support for the conductor 204, as described elsewhere herein. It will be appreciated that the configuration of the backing 218 (e.g., number of segments, the orientation of each segment, the width and length of each segment and of the backing 218 as a whole) is adapted to the geometry and physical constraints of the firearm, and that the configuration of the backing 218 shown in FIG. 2B is for illustration purposes only. The backing may be manufactured by, for example, molding or thermoforming.

The elongate conductor frame 216 includes a plurality of clips 220 attached to, or integral with, the backing 218. Each of the clips 220 is designed and configured to urge a portion of the conductor 204 against a surface of the backing 218, thus securing the conductor 204 to the backing 218. In some examples, each of the clips 220 is elastic or has an elastic component of its mechanical properties so that each of the clips 220 can be (1) flexed during placement of the conductor 204 within the conductor frame 216 and (2) returned to a position that provides a compressive force urging the conductor 204 against a surface of the backing 218. In other embodiments a connector such as an adhesive can be used to secure conductor 204 to the backing 218.

The elongate conductor frame 216 defines a plurality of fixture channels 224. Each of the fixture channels 224 defined by the elongate conductor frame 216 (or defined by another structure attached to the elongate conductor frame 216) is configured to receive a fixture pin or other fastener. Each fixture pin is placed through a fixture hole defined by a firearm frame mold and into a corresponding one of the fixture channels 224 to which the fixture hole is aligned. Thus, the position of the elongate conductor frame 216 (and/or its various segments) is fixed within a mold used to fabricate the firearm frame 100. In this way, the elongate conductor frame 216 does not move relative to the firearm frame mold during molding because of, for example, forces applied by the polymer that is blown or injected into the mold.

The cross-section, depth, and location of the fixture channels are determined based on the configuration of the firearm in which the elongate conductor frame 216 is used. However, in some examples, the fixture channels 224 are disposed at positions on the elongate conductor frame 216 where (a) forces due to the molding of the corresponding firearm frame 100 are expected to be high and/or asymmetric and/or (b) where maintenance of the position of the elongate conductor frame 216 is desired. For example, a fixture channel 224*a* is shown as disposed proximate to the power source contact 208. This fixture channel 224*a* fixes the position of the elongate conductor frame 216 relative to the firearm frame mold, and the conductor 204 disposed thereon. In this way, the power source contact 208 is not moved out of position during molding, thus ensuring that a functioning electrical contact can be made with a power source ultimately placed in the power source compartment 120. Similarly, another fixture channel 224*d* provides positional stability to the second end of the elongate conductor frame 216, and the conductor 204 disposed thereon, that is proximate to the socket 124. In this way, a functioning electrical connection can be made between the conductor 204 and the socket 124. Absent these fixture channels 224 (or some equivalent fixture by which relative movement between the conductor assembly 104 and the firearm frame mold is reduced), it is more likely that the power source electrical contact 208 and the connector 112 are displaced from preferred positions during manufacturing, thus making it more difficult to establish the functioning electrical connections described above.

Other fixture channels 224 are shown as disposed between the first and second ends of the elongate conductor frame 216, in this example at points at which a portion of the elongate conductor frame 216 changes its orientation with respect to adjacent portions of the elongate conductor frame 216. For example, as shown in FIG. 2B, a fixture channel 224*b* is disposed adjacent the switch 210. This location corresponds to a change in orientation of the elongate conductor frame 216 as it transitions from a portion within the grip 106 to a portion within the trigger guard 108. Similarly, another fixture channel 224*c* is disposed at a point corresponding to a corner of the trigger guard 108. The fixture channel 224*d* is disposed at a point corresponding to a transition of the elongate conductor frame 216 as it transitions from the trigger guard 108 to the barrel assembly frame 112. As indicated above, this fixture channel 224*d* also serves to stabilize the position of the connector 212.

As indicated above, the specific locations of fixture channels 224 shown in FIG. 2B are for convenience of explanation only and do not limit the scope of alternative embodiments encompassed by the present disclosure. The location and number of fixture channels 224 may be varied to provide positional stability depending on the configuration of the conductor assembly 104. The location and number of fixture channels 224 will vary on the type of molding process and materials used to fabricate the firearm frame 100, the configuration of the firearm frame 100, the points of greatest stress during molding, and the configuration of the conductor assembly 104.

In some examples, the fixture channels 224 may also include a joint that joins two separate segments of the elongate conductor frame 216 for examples of the elongate conductor frame 216 that are not fabricated as a single piece that conforms to a configuration and route through the firearm frame 100. For example, for an elongate conductor frame 216 fabricated from joined segments, the fixture channel 224 may actually include two complementary halves, each half associated with one of two adjacent segment of the elongate conductor frame 216. The complementary halved may be joined together in a door hinge design. These joints facilitate changes in orientation of the segments of the elongate conductor frame 216 (such as, for example, at fixture channel 224*b* or 224*c*). In other examples, changes in orientation of the segments are accomplished by fabricating a single-piece elongate conductor frame 216 into a shape that corresponds to a path within the firearm frame 100 to be followed by the conductor assembly 104. In embodiments of this latter example, a conductor 204 (whether a flex circuit or one or more insulated wires) can be overmolded with an insulating polymer into the configuration used for a particular firearm. In this embodiment, the plurality of clips 220 and the above-described joints are not necessary.

As will be appreciated, portions of the elongate conductor frame 216 may be configured to form a barrier against polymer flow during molding of the firearm frame 100. That is, raised portions of the elongate conductor frame 216 may be configured to contact an additional inserted plate or a portion of a firearm frame mold so that material introduced into the firearm frame mold does not intrude into the protected area. For example, in the example shown, the elongate conductor frame 216 includes a portion around the switch 210 so that injected polymer does not impair the functioning of the switch 210. In some embodiments, this portion may be sacrificial or may be removed after molding to provide space for installation of a switch or other feature.

Figure 3:
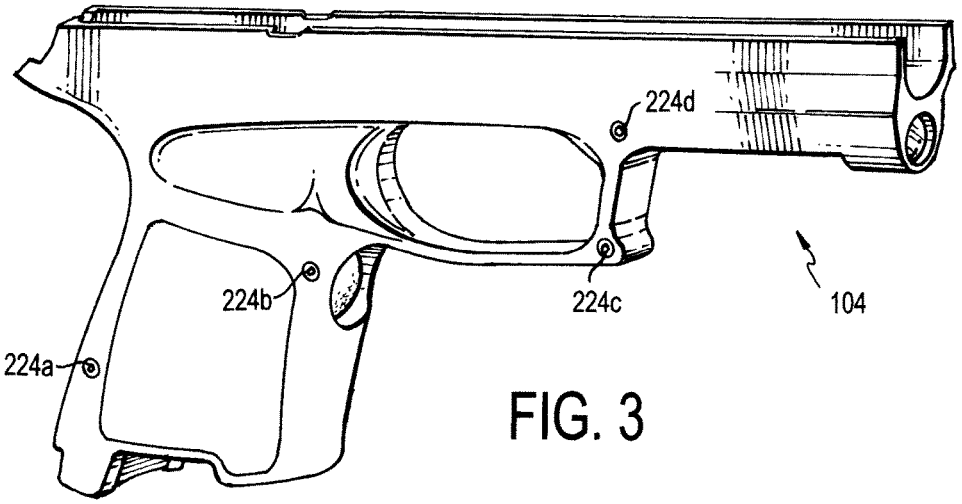
FIG. 3 is a perspective view of a firearm that includes a plurality of fixture channels used to fix a position of an elongate conductor frame within a firearm mold during molding of a firearm frame, in an embodiment of the present disclosure.

FIG. 3 is a perspective view of the firearm frame 100 that illustrates the locations of the fixture channels 224 that are exposed in the as-molded firearm frame 100. That is, the elongate conductor frame 216 is fixed in position within a mold of the firearm frame 100 using fixture pins (not shown) that pass through the mold and into some or all of the fixture channels 224. The polymer that fills the mold to form the firearm frame 100 flows around the space occupied by the fixture pins. Because the fixture channels 224 are thus occupied by the fixture pins that pass through the mold and into the fixture channels 224, in some embodiments the fixture channels 224 are exposed upon removal of the fixture pins after molding of the firearm frame 100, as shown in FIG. 3. In other embodiments, the fixture pins can include a sacrificial portion so that a portion of the pin remains in the fixture channel 224 after the mold is removed from the molded firearm frame 100, thus filling the fixture channel. In some embodiments, the fixture pin exit points can receive screws or other connectors that can attach the firearm frame to the receiver or accessories. In other cases, the exit points can be molded over or filled.

Power Source Compartment and Power Source Module

Figure 4A:
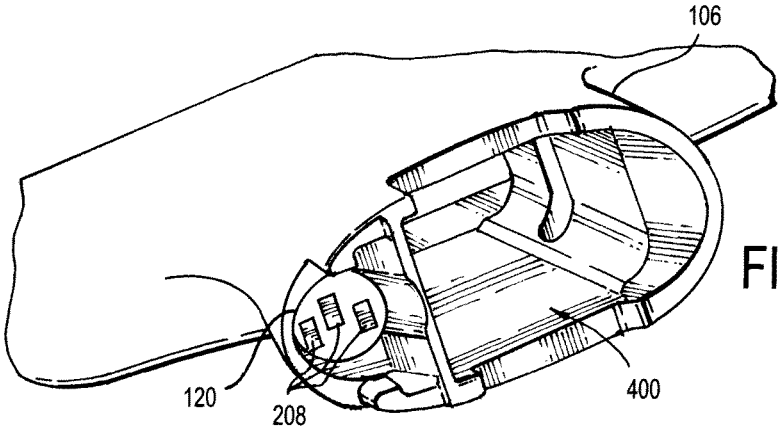
FIG. 4A is a perspective view of a firearm grip that includes an integrated power source compartment configured to receive a removable power source module, in an embodiment of the present disclosure.

FIG. 4A illustrates a perspective view of a firearm grip 106 that defines a power source compartment 120 configured to receive a removable power source module, in an embodiment of the present disclosure. As shown in FIG. 4A (and FIG. 1), the power source compartment 120 is defined by the molded grip 106 of the firearm frame 100, which is accomplished using an appropriately configured mold. As can also be seen in FIG. 4A, the power source compartment 120 defined by the grip 106 also defines a first opening so that the power source contact 208 of the conductor 204 is exposed. The power source contact 208 is then available to make a functional electrical contact, either directly or indirectly, with the power source. Also show in this view is a magazine compartment 400 configured to receive a magazine of ammunition.

Figure 4B:
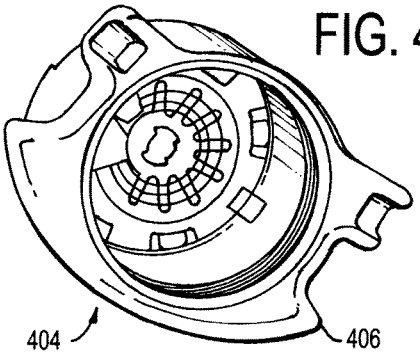
FIGS. 4B and 4C are perspective views of a power source module configured to receive one or more portable power sources (e.g., batteries) and that is configured to be secured in the integrated power source compartment of a firearm, in an embodiment of the present disclosure.
Figure 4C:
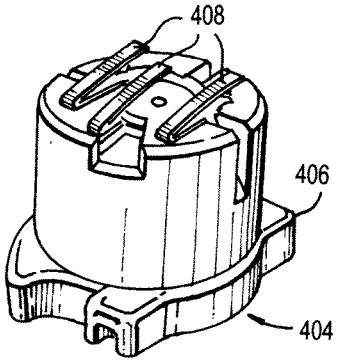

FIGS. 4B and 4C are perspective views of a power source module 404 configured to receive one or more batteries (or other portable power sources) and further configured to be secured in the integrated power source compartment 120, in an embodiment of the present disclosure. The power source module includes a housing 406 that defines a receptacle for the one or more portable power sources and a conductive interface 408.

The housing 406 defines various holes to facilitate insertion of the conductive interface 408 into the housing 406 that facilitates contact between the portable power source and the power source contact 208 of the conductor 204. The conductive interface 408 includes portions that contact the power source contact 208, and which are in turn connected to portions that contact the portable power source (not shown). In some examples, the conductive interface 408 is a stamped piece of conductive metal (e.g. copper, aluminum) that is inserted through the holes defined by the housing 406.

While the power source compartment 120 is configured in this example to receive the power source module 404, this is not required. In other embodiments, the power source compartment 120 may be configured to receive a power source directly. Examples of power sources include one or more removable batteries or fuel cells, and even re-chargeable batteries or fuel cells that can be integrated into the frame. The power source compartment 120, and the housing 406, can be configured to receive any of a variety of types, sizes, and shapes of portable power sources.

Accessory Socket

Figure 5:
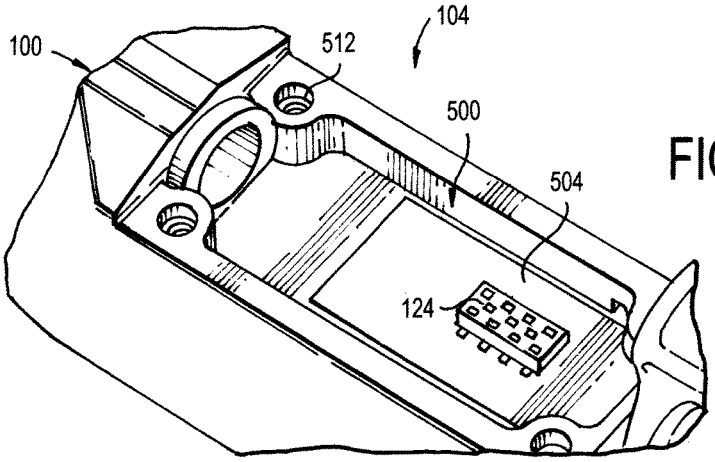
FIG. 5 illustrates a socket integrated into a firearm and that provides power to an attached accessory from a power source disposed within the integrated power source compartment of a firearm, in an embodiment of the present disclosure.

FIG. 5 illustrates a socket assembly 500 integrated into a firearm. The socket assembly 500 provides power to an attached accessory from a power source disposed within the integrated power source compartment of the firearm, in an embodiment of the present disclosure. The socket assembly includes a printed circuit board (PCB) 504 and the socket 124. Conventional features used for the operation of electronics, such as capacitors, resistors, PCB wiring, and microcontrollers are omitted for clarity of explanation. The socket assembly 500 may also include specific or universal connectors for various accessories.

In the embodiment shown, the PCB 504 includes contacts used to receive power from either the conductor assembly 104 directly or from the conductor 104 through the connector 212, as described above. The power is then transferred from the conductor 104 or the connector 212 to the socket 124 through various electrical features of the PCB 504 and connected to the PCB 504.

The PCB 504 is connected to the firearm frame 100 using any convenient means. In some examples, the connection of the PCB 504 to the firearm frame 104 is by an interference fit with mounting features molded into the firearm frame 100. In other examples, the PCB is glued or otherwise adhered to the firearm frame 100. In still other examples, the PCB is fastened to the firearm frame 100 using any of a releasable fastener, such as a screw, that mates with a corresponding feature molded, attached, or otherwise mounted within the firearm frame 100. In one embodiment, the PCB can be molded into the frame during the frame molding process.

A PCB 504 that is securely fastened to the firearm frame 100 thus provides a stable surface on which to mount the socket 124. As described above, the socket 124 can be any feature configured to provide an electrical connection to a compatible plug associated with a powered accessory. The socket 124 includes electrical leads that connect to the wiring of the PCB 504 to form an electrical connection with the power source.

In the example shown, a multi-pin socket 124 is shown that can supply power (and optionally control signals) to an accessory equipped with a complementary multi-pin connector plug. However, the multi-pin socket 124 is shown only for convenience of explanation. Other examples of different types of sockets 124 can be used without department from the scope of the present disclosure.

To provide a mechanically secure fixture in demanding service environments, threaded holes 512 are also provided in the firearm frame 100 as shown in the perspective view of FIG. 5. These threaded holes 512 provide a secure connection between the firearm frame 100 and an accessory with compatible, and compatibly located, connectors. The threaded holes 512 may be molded directly as features within the firearm frame 100 or be inserted as separate units into receptacles defined in the firearm frame 100. The holes may be threaded directly into the frame material or may be, for example, metal or polymeric bosses that are molded into or inserted into the frame material.

Method of Fabrication

Figure 6:
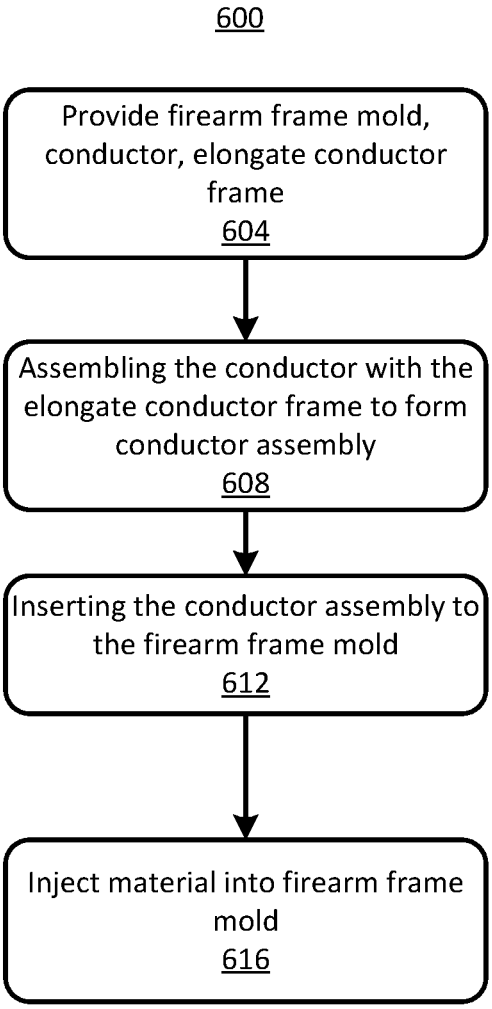
FIG. 6 is a method flow diagram of a method of manufacturing a firearm that includes a conductor on a conductor frame disposed within a firearm that is used to provide power from an integrated power source to an integrated powered accessory, in an embodiment of the present disclosure.

FIG. 6 is a method flow diagram of a method 600 of manufacturing a firearm that includes a conductor on a conductor frame disposed within a firearm that is used to provide power from an integrated power source to an integrated powered accessory, in an embodiment of the present disclosure.

The method 600 begins by providing 604 a firearm frame mold, a conductor, and an elongate conductor frame. In some examples a plurality of fixture pins are also provided. The conductor is assembled 608 with the elongate conductor frame to form a conductor assembly, such as the conductor assembly 104 show in FIGS. 1 and 2B and described above. As described above, the assembly 608 can be accomplished by mounting a conductor on an elongate conductor frame and using clips to urge the conductor toward a surface of the elongate conductor frame (or the segments thereof). In other embodiments, a conductor, such as a bare or insulated wire, can be overmolded with a polymer or filled polymer to form the conductor assembly.

The conductor assembly is inserted 612 into the firearm frame mold. In one example, the inserting 612 of the conductor assembly into the firearm frame mold includes using a firearm frame mold with a plurality of fixture holes that are defined by the firearm frame mold and a conductor assembly in which the elongate conductor frame defines a plurality of fixture channels. At least some of the fixture holes of the firearm frame mold are aligned with corresponding fixture channels in the elongate conductor frame. Fixture pins are then inserted through each of the fixture holes in the firearm frame mold aligned with a corresponding fixture channel. In this way, as described above, the position of the conductor assembly (or the positions of various segments of the conductor assembly) is fixed relative to the firearm frame mold so that the conductor assembly does not move during molding. Portions of the conductor assembly that are not directly retained by fixture pins can be deflected during the molding process without affecting the end product.

A material is then injected 616 into the mold, such as a polymer, polymer blend, filled polymer, filled polymer blend, or polymer composite material, to form the firearm frame. The material is cured and the firearm frame, including its electrical functionality, is removed from the mold. Fixture pins can be removed from the fixture channels and resulting holes can be filled or used to attach additional portions of the firearm, such as the receiver, to the firearm frame.

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A firearm comprising:
- a grip;
- a barrel assembly frame connected to the grip;
- a trigger guard connected to the grip and the barrel assembly frame;
- an elongate conductor frame disposed within the firearm having a first frame end and a second frame end, the first frame end disposed within the grip and the second frame end disposed at an end of the barrel assembly frame opposite the grip; and
- a conductor in contact with the elongate conductor frame, wherein the conductor comprises
  - a first conductor end disposed proximate to the first frame end of the elongate conductor frame, the first conductor end including at least one electrical contact point, and
  - a second conductor end disposed proximate the second frame end of the elongate conductor frame.

2. The firearm of claim 1, wherein the second conductor end is connected to a socket disposed on an underside of the barrel assembly frame.

3. The firearm of claim 2, wherein the socket is a multi-pin socket.

4. The firearm of claim 1, wherein a portion of the conductor is disposed within the trigger guard.

5. The firearm of claim 1, wherein the conductor is a flex circuit.

6. The firearm of claim 1, wherein the elongate conductor frame includes a plurality of clips configured to urge a conductor against a surface of the elongate conductor frame.

7. A firearm comprising:
- a grip;
- a barrel assembly frame connected to the grip;
- a trigger guard directly connected to the grip and the barrel assembly frame; and
- an elongate conductor frame disposed within the firearm having a first frame end and a second frame end, the first frame end disposed within the grip and the second frame end disposed at an end of the barrel assembly frame opposite the grip,
- wherein the elongate conductor frame includes a plurality of clips configured to urge a conductor against a surface of the elongate conductor frame.

8. A firearm comprising:
- a grip;
- a barrel assembly frame connected to the grip;
- a trigger guard directly connected to the grip and the barrel assembly frame; and
- an elongate conductor frame disposed within the firearm having a first frame end and a second frame end, the first frame end disposed within the grip and the second frame end disposed at an end of the barrel assembly frame opposite the grip,
- wherein the elongate conductor frame defines a plurality of fixture channels, each fixture channel of the plurality configured to receive a fixture pin inserted through a firearm injection mold that defines a plurality of fixture holes.

9. A firearm comprising:
- a grip;
- a barrel assembly frame connected to the grip;
- a trigger guard directly connected to the grip and the barrel assembly frame;
- an elongate conductor frame disposed within the firearm having a first frame end and a second frame end, the first frame end disposed within the grip and the second frame end disposed at an end of the barrel assembly frame opposite the grip; and
- a power source compartment defined by the grip, the power source compartment configured to receive a portable power source.

10. A firearm comprising:
- a grip;
- a barrel assembly frame connected to the grip;
- a trigger guard directly connected to the grip and the barrel assembly frame;
- an elongate conductor frame disposed within the firearm having a first frame end and a second frame end, the first frame end disposed within the grip and the second frame end disposed at an end of the barrel assembly frame opposite the grip; and
- a powered accessory connected to the barrel assembly frame.

11. A method of manufacturing a firearm frame having an integrated power circuit, the method comprising:
- providing:
  - a firearm frame mold;
  - a conductor;
  - an elongate conductor frame;

assembling the conductor with the elongate conductor frame to form a conductor assembly;

inserting the conductor assembly into the firearm frame mold; and injecting a material into the firearm frame mold.

12. The method of claim 11, wherein the providing further comprises:

providing the firearm frame mold with a plurality of fixture holes defined by the firearm frame mold;

providing the elongate conductor frame with a plurality of fixture channels defined by the elongate conductor frame; and providing a plurality of fixture pins.

13. The method of claim 12, further comprising connecting the conductor assembly to the firearm frame mold by:

aligning at least some of the fixture holes of the firearm frame mold with corresponding fixture channels of the elongate conductor frame; and inserting a fixture pin of the plurality of fixture pins through each fixture hole aligned with a corresponding fixture channel.

14. The method of claim 11, wherein assembling the conductor with the elongate conductor frame comprises mounting the conductor on a surface of the elongate conductor frame.

15. The method of claim 14, wherein the mounting comprises urging the conductor to the surface of the elongate conductor frame using at least one clip.

* * * * *